United States Patent [19]

Mizuno et al.

[11] Patent Number: 4,961,363

[45] Date of Patent: Oct. 9, 1990

[54] CONTROL UNIT FOR ELECTRONIC MUSICAL INSTRUMENT

[75] Inventors: Kotaro Mizuno; Yasuhiko Asahi, both of Hamamatsu, Japan

[73] Assignee: Yamaha Corporation, Hamamatsu, Japan

[21] Appl. No.: 321,524

[22] Filed: Mar. 8, 1989

[30] Foreign Application Priority Data

Mar. 8, 1988 [JP] Japan ..... 63-54044

[51] Int. Cl.[5] ..... G10H 7/00; G10H 5/00; G10H 1/32

[52] U.S. Cl. ..... 84/615; 84/626; 84/644; 84/653; 84/678

[58] Field of Search ..... 84/1.01, 1.24, 1.25, 84/DIG. 7, DIG. 2, 454, 615, 626, 629, 644, 653, 662, 678, 687, 701, 705, 706, 715, 454; 84/615, 626, 629, 644, 653, 662, 678, 687, 701, 705, 706, 715, 454, DIG. 2, DIG. 7

[56] References Cited

U.S. PATENT DOCUMENTS

| | | | |
|---|---|---|---|
| 4,179,971 | 12/1979 | Takahashi et al. | 84/1.24 |
| 4,347,772 | 9/1982 | Nishimoto | 84/1.03 |
| 4,653,374 | 3/1987 | Iba | 84/1.01 |
| 4,777,857 | 10/1988 | Stewart | 84/1.01 |
| 4,791,847 | 12/1988 | Nishimoto | 84/1.24 X |
| 4,794,838 | 1/1989 | Corrigan, III | 84/1.24 X |
| 4,813,327 | 3/1989 | Abe | 84/1.24 X |

*Primary Examiner*—A. T. Grimley
*Assistant Examiner*—Matthew Smith
*Attorney, Agent, or Firm*—Spensley Horn Jubas & Lubitz

[57] ABSTRACT

An electronic musical instrument can be provided with a control unit capable of arbitrarily shifting a tone pitch of a key within a keyboard from its reference tone pitch. This control unit includes a plurality of pitch-bend switches to which predetermined pitch values are respectively assigned. Each of these pitch-bend switches has a shape which can be easily operated by a player with high speed. The tone pitch of each key can be incremented or decremented by the predetermined pitch value from its reference tone pitch when the switches are operated by the player.

9 Claims, 5 Drawing Sheets

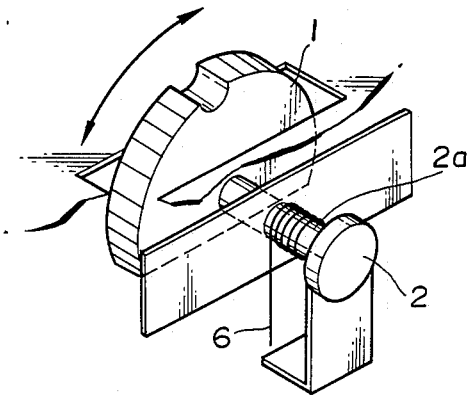
FIG. 1 *(PRIOR ART)*
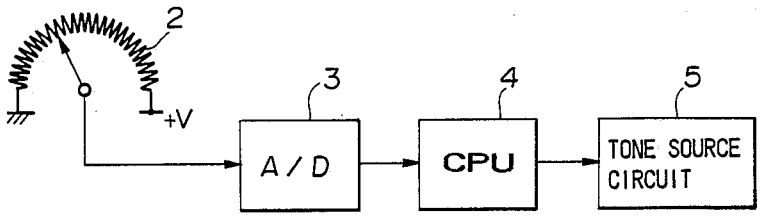
FIG. 2 *(PRIOR ART)*

CONTROL UNIT FOR ELECTRONIC MUSICAL INSTRUMENT

BACKGROUND OF THE INVENTION

1. Field of the Invention

The present invention relates to a control unit for an electronic musical instrument, and more particularly to a control unit for an electronic musical instrument which is suitable for controlling tone pitch, tone color, tone volume and the like of a musical tone.

2. Prior Art

Some conventional electronic musical instruments provide pitch-bend units (see Japanese Patent Publication No. 61-47433, i.e., U.S. Pat. No. 4,347,772) each of which can continuously and arbitrarily change the tone pitch of musical tone by a manual operation of a switch and the like. FIG. 1 is a perspective side view showing partial constitution of an operation portion of such pitch-bend unit. In FIG. 1, 1 designates a wheel to be operated by a player, and this wheel 1 is mounted to a rotation shaft 2*a* of rotary volume (or rotary controller) 2. The voltage obtained at an edge of sliding element of this rotary volume 2 is supplied to an analog-to-digital (A/D) converter 3 shown in FIG. 2, wherein this voltage is converted into a digital signal which is to be supplied to a central processing unit (CPU) 4. Based on the data value of such digital signal, the CPU 4 controls a tone pitch of musical tone signal to be generated from a tone source circuit 5. In addition, the rotation shaft 2*a* of rotary volume 2 is mounted with a return spring 6. By elastic force of this return spring 6, the rotation shaft 2*a* is returned to its center position. When the player revolves the wheel 1 in the forward or backward direction while depressing a key of an electronic musical instrument, the tone pitch of a musical tone to be generated is raised or lowered from the reference tone pitch of the depressed key in response to a revolution angle of this wheel 1. Thus, it is possible to obtain the musical effect which can be caused by operating a tremolo arm of an electric guitar, for example.

In the above-mentioned conventional unit, the revolution angle of wheel 1 must be enlarged in order to largely change the tone pitch of a musical tone. However, such operation is difficult for the player. In some cases, the tone pitch is to be vibrated as it is in a vibrato performance. However, it is extremely difficult to play such performance by revolving the wheel 1.

Further, due to the variation of the return spring 6 whose elastic force will be varied in the lapse of time, its central position must be varied so that the tone pitch of a musical tone will be sometimes returned and fixed at the tone pitch which is undesirably shifted from the reference tone pitch thereof. Furthermore, this rotary volume 2 requires the A/D converter 3, which will raise the cost of this unit.

SUMMARY OF THE INVENTION

It is accordingly a primary object of the present invention to provide a control unit for electronic musical instrument capable of applying several performance effects to the musical tone with easy manual operation.

It is another object of the present invention to provide a control unit for electronic musical instrument in which the reference tone pitch of each key is not deviated in the lapse of time and which does not require the A/D converter.

In an aspect of the present invention, there is provided a control unit for electronic musical instrument comprising:

(a) a plurality of switches each of which is assigned with its predetermined value and which can be operated by a player;

(b) detecting means for detecting an operation state of each switch; and (c) control means for smoothly varying a value of control data from its present value to a target value corresponding to an operated switch when the detecting means detects that any one of the switches is operated, the control data being used for controlling a musical tone, the control means smoothly reverting the value of control data from its present value to its predetermined reference value when the detecting means detects that no switch is operated.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 1 is a perspective side view showing the mechanism of conventional pitch-bend switch;

FIG. 2 is a block diagram showing an electric circuit for conventional pitch-bend control;

DESCRIPTION OF A PREFERRED EMBODIMENT

Hereinafter, description will be given with respect to the control unit for an electronic musical instrument according to an embodiment of the present invention.

[A] CONSTITUTION OF EMBODIMENT

Figure 3:
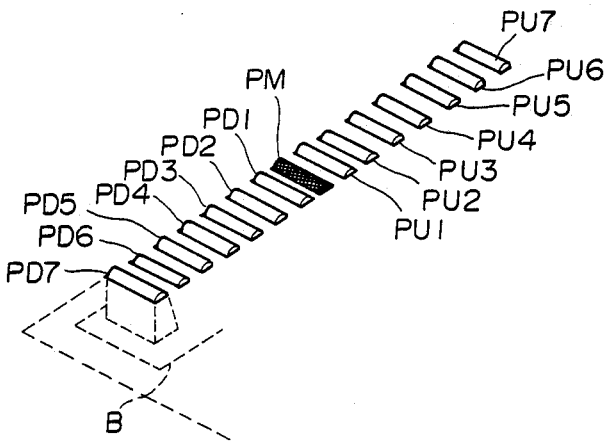
FIG. 3 is a perspective side view showing an appearance of an essential portion in the control unit for an electronic musical instrument according to an embodiment of the present invention.
Figure 4:
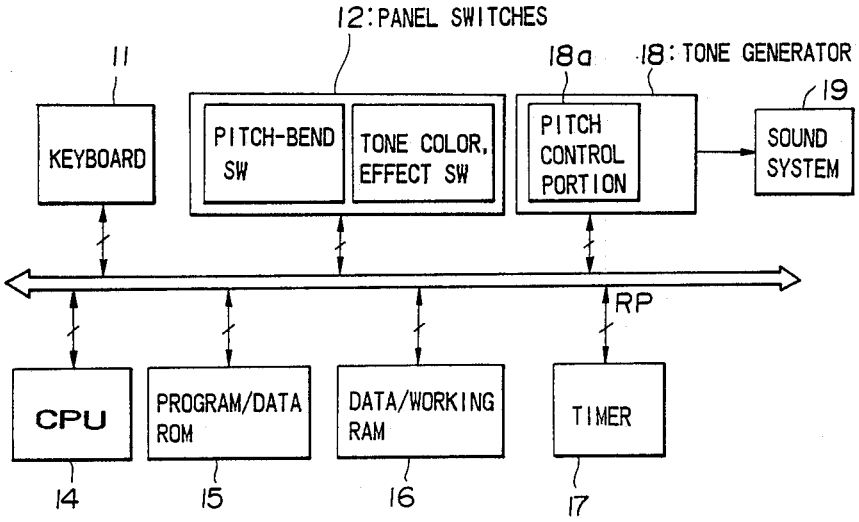
FIG. 4 is a block diagram showing an electric constitution of the present embodiment.

FIG. 4 is a block diagram showing an embodiment of the present invention. In FIG. 4, 11 designates a keyboard providing plural keys and key switches each of which detects an on/off state of each key. And, 12 represents panel switches provided on a console panel, wherein these panel switches include a tone color switch for selecting the tone color, an effect switch for selecting the musical effect and pitch-bend switch (or pitch-bend button) for designating the level of tone pitch. FIG. 3 shows an example of pitch-bend switches.

In FIG. 3, PU1 to PU7 are pitch bend switches each designating a pitch-up operation, while PD1 to PD7 are other pitch-bend switches each designating a pitch-down operation. As shown in FIG. 3, these pitch-bend switches PU1 to PU7 and PD1 to PD7 are disposed in one line. In addition, a projection PM is arranged between the pitch-bend switches PU1 and PD1 in order to indicate the center position of fourteen pitch-bend switches. Each of the pitch-bend switches PU1 to PU7 designates the pitch-up operation by 28.5 cents (wherein 100 cents equal to semi-tone or half tone) as its number is increased by one. On the other hand, each of the pitch-bend switches PD1 to PD7 designates the pitch-down operation by 28.5 cents as its number is increased by one. Therefore, it is possible to designate the pitch variation of ±200 cents by use of these fourteen pitch-bend switches. In addition, a switch such as a film switch or rubber switch is provided under each pitch-bend switch, so that the corresponding switch must be turned on when the pitch-bend switch is depressed. Each switch is given by the predetermined switch code. By use of such switch code, it is possible to discriminate the switch to be turned on (i.e., the pitch-bend switch which is depressed).

Next, 14 in FIG. 4 designates a CPU for controlling several parts of the present unit. In addition, 15 designates a program/data read only memory (ROM) which includes a program ROM for storing programs used in the CPU 14 and a data ROM for storing several kinds of data, and 16 designates a data/working random access memory (RAM) for storing several kinds of data and also setting registers. This ROM 15 stores a preset pitch control data table for storing pitch control data which correspond to pitch control amounts (e.g., +28.5 cents, +57 cents, . . . , +199.5 cents, −28.5 cents, . . . , −199.5 cents) each assigned to each pitch-bend switch. Incidentally, the data written in the RAM 16 will be described later.

Further, 17 designates a timer which outputs a pulse signal RP having the constant cycle to the CPU 14. When this pulse signal RP is supplied to the CPU 14, the CPU 14 starts to execute an interrupt process. Next, a tone generator 18 generates the musical tone based on key data (including a key code indicative of the key and data indicative of the on/off state of the key), musical tone control data and the like outputted from the CPU 14. This musical tone signal is supplied to a sound system 19, from which the corresponding musical tone is generated. Plural tone-generation channels are provided within the tone generator 18, wherein the CPU 14 properly assigns the key whose tone is to be generated to each tone-generation channel. Within the tone generator 18, a pitch control portion 18*a* for controlling the tone pitch in each tone-generation channel is provided. This pitch control portion 18*a* executes the pitch control based on the pitch control data within several kinds of musical tone control data supplied from the CPU 14.

Next, description will be given with respect to main registers which are set within the RAM 16.

(1) Register SWNO in which the switch code of operated pitch-bend switch is written;

(2) Register TVAL in which a target value of pitch-bend amount (i.e., target value of the variation of pitch control data) is written;

(3) Register CVAL in which a present value of pitch-bend amount (i.e., present value of pitch control data) is written;

(4) Other registers each written by switch information of the key switch and tone color switch etc. and data indicative of an assigning state of each channel.

[B] OPERATION OF EMBODIMENT

Next, description will be given with respect to the operation of the present embodiment.

Figure 5:
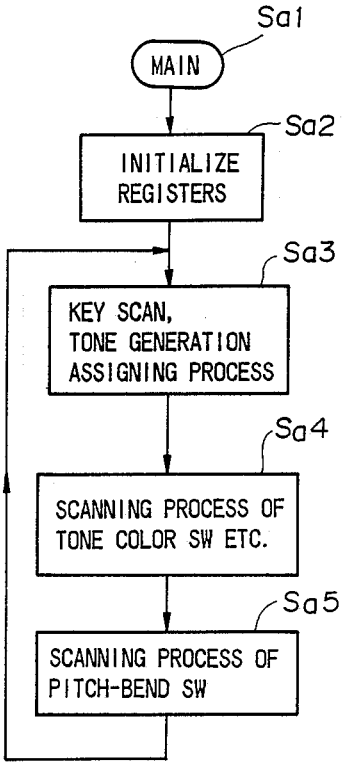
FIG. 5 is a flowchart showing a main routine process.

First, the present embodiment starts to operate the main routine process from a step Sa1 shown in FIG. 5, and then several kinds of registers within the RAM 16 are initialized in a next step Sa2a. Next, the processing proceeds to a step Sa3 wherein the CPU 14 scans each key of the keyboard 11 to thereby detect the variation of its on/off state. Based on such detection result, the tone-generation channel is assigned to the key whose tone is to be generated, or tone-generation control process is executed on the key whose tone generation must be ended. In a next step Sa4, scanning process is executed on the tone color switch and effect switch, and then the musical tone control data for setting the tone color and musical effect are supplied to the tone generator 18 based on those on/off states. After executing this process of step Sa4, the processing proceeds to a step Sa5 wherein the pitch-bend switch process is to be executed. In this step Sa5, the CPU 14 scans and then detect the events of pitch-bend switches. In the present embodiment, the subroutine process as shown in FIG. 6A is executed when there is an on-event in the pitch-bend switch, while another subroutine process as shown in FIG. 6B is executed when there is an off-event in the pitch-bend switch.

Figure 6A:
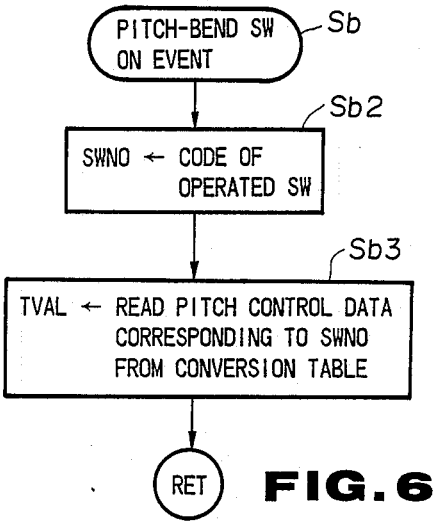
FIGS. 6A and 6B are flowcharts showing a subroutine for pitch-bend switch.

When the on-event is detected in the pitch-bend switch, the processing proceeds from a step Sb1 to a step Sb2 shown in FIG. 6A wherein the switch code of the operated pitch-bend switch is written in the register SWNO. Next, the processing proceeds to a step Sb3 wherein the pitch control data whose value corresponds to the switch code written in the register SWNO are read from the conversion table within the ROM 15 and then the read pitch control data are written in the register TVAL. After executing this process of step Sb3, the processing returns to the main routine.

Figure 6B:
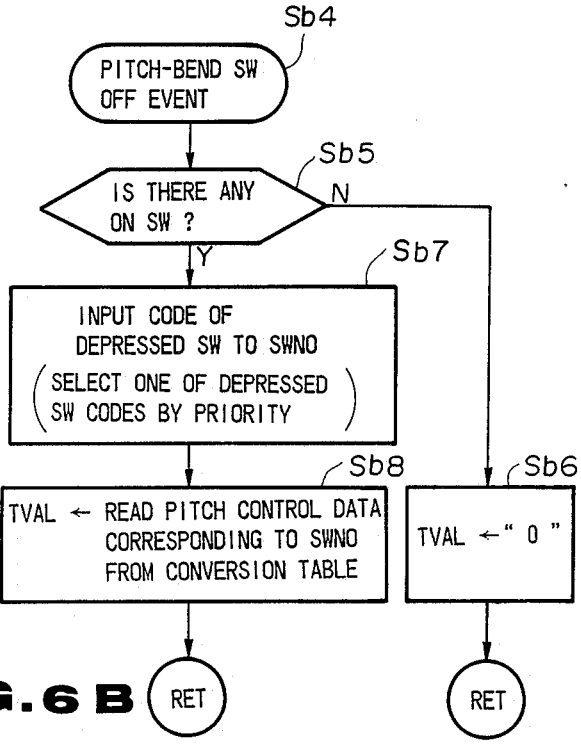

On the contrary, when the off-event is detected in the pitch-bend switch, the processing proceeds to a step Sb5 via a step Sb4 shown in FIG. 6B. In the step Sb5, it is judged whether or not there is another pitch-bend switch which is turned on. If the judgement result of this step Sb5 is "NO", all of the pitch-bend switches are turned off so that any pitch change is not designated at all. In this case, the processing proceeds to a step Sb6 wherein the register TVAL is cleared, i.e., the reference value "0" is set to the register TVAL. Thereafter, the processing returns to the main routine process.

When the judgement result of step Sb5 turns to "YES", the processing proceeds to a step Sb7 wherein the switch code of a presently depressed pitch-bend switch is written in the register SWNO. In this case, when plural pitch-bend switches are depressed, one of them is selected based on the predetermined priority and then the switch code of the selected pitch-bend switch is written in the register SWNO. This priority can be determined as the order of PU7, PU6, . . . , PU1, PD7, PD6, . . . , PD1. Or, this priority is set as the priority on a first-come first-selected basis or another priority on a last-come last-selected basis. Next, the processing proceeds to a step Sb8 wherein the pitch control data whose value corresponds to the switch code written in the register SWNO are read from the conversion table within the ROM 15 and then the read pitch control data are written into the register TVAL as the target value data. Thereafter, the processing returns to the main routine process shown in FIG. 5.

The above is the pitch-bend switch process, according to which the data indicative of the target value of pitch-bend amount are set in the register TVAL. Such target value data (i.e., the target value of pitch control data) will be used in the timer interrupt process which will be described below.

Figure 7:
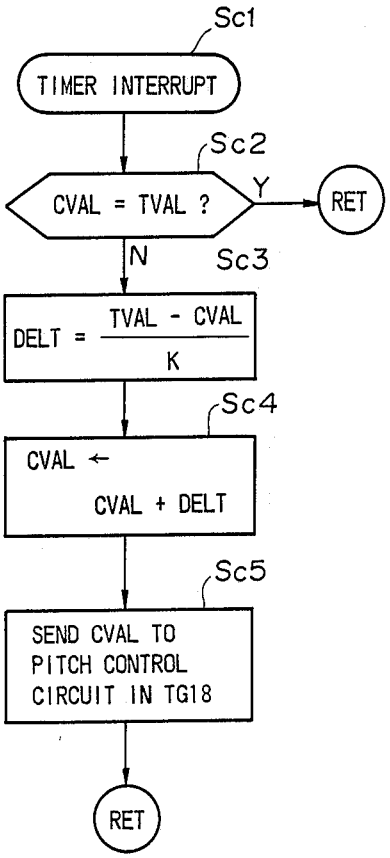
FIG. 7 is a flowchart showing a subroutine for timer interrupt process.

Next, when the timer 17 outputs the pulse signal RP, the CPU 14 is interrupted, so that the timer interrupt process as shown in FIG. 7 is started. In this case, the processing proceeds to a step Sc2 via a step Sc1, wherein it is judged whether the storing contents of register CVAL is equivalent to those of register TVAL or not. If the judgement result of this step Sc2 is "YES", it is judged that the target value data of pitch-bend amount (stored in the register TVAL) are equivalent to the present pitch control data (CVAL), so that the processing immediately returns to the main routine process because there is no need to renew the present pitch control data. On the contrary, when the judgement result of step Sc2 turns to "NO", the processing proceeds to a step Sc3 wherein the CPU 14 executes the operation of (TVAL-CVAL)/K to thereby write its operation result into a register DELT. Herein, K designates a coefficient whose value is determined in advance.

Next, the processing proceeds to a step Sc4 wherein the storing value of the register CVAL is added to another storing value of the register DELT. Then, the addition result is written into the register CVAL again. Thereafter, the processing proceeds to a step Sc5 wherein the storing contents of the register CVAL (i.e., the new present value of pitch control data) is supplied to the pitch control circuit 18*a* within the tone generator 18. Thus, the tone generator 18 generates the musical tone signal whose pitch is shifted from its original pitch by the value corresponding to the pitch control data stored in the register CVAL. After the process of step Sc5 is completed, the processing returns to the main routine process.

When the pulse signal RP is supplied to the CPU 14 again, the subroutine process as shown in FIG. 7 is executed again. By repeatedly executing this subroutine process, the value of pitch control data stored in the register CVAL gradually approaches to the value of target value data stored in the register TVAL due to the processes of steps Sc3 and Sc4. More specifically, the pitch of musical tone generated from the sound system 19 is gradually varied based on the pitch-bend amount designated by operating the pitch-bend switch. After such pitch variation becomes identical to the designated pitch-bend amount, in other words, after the pitch control data (CVAL) coincide with the target value data (TVAL), the judgement result of step Sc2 must turn to "YES" sc that the pitch control data will not be renewed.

Figure 8A:
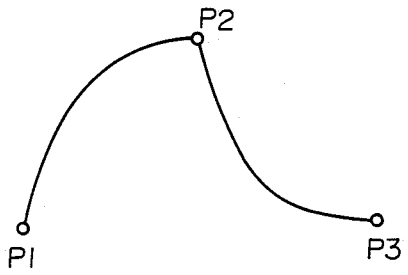
FIGS. 8A and 8B are diagrams showing the variation of pitch control data.
Figure 8B:
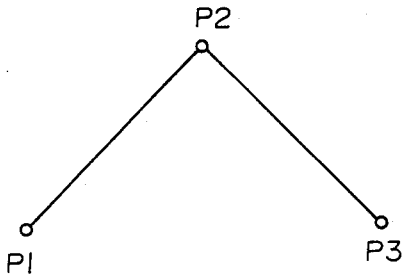

In this case, the pitch control data are varied by every variation value corresponding to the difference between its present value and target value in the steps Sc3 and Sc4. Therefore, the value of pitch control data must gradually approach to the target value in an exponential manner as shown in FIG. 8A. In FIG. 8A, the curve between P1 and P2 indicates the state where the pitch is raised by depressing the pitch-bend switch (PU1 to PU7), while its subsequent curve between P2 and P3 indicates the state where the raised pitch is lowered to the original pitch by releasing such pitch-bend switch. Meanwhile, by re-designing the present embodiment such that the fixed value is sequentially added to the storing value of register CVAL, it is possible to fix the variation value. In such case, the pitch variation can be shown by FIG. 8B.

Next, description will be given with respect to an operation example of the pitch-bend switch in the present embodiment.

(1) The player depresses the pitch-bend switches PU7 and PD7 (shown in FIG. 3) alternatively. As a result, due to the subroutines as shown in FIGS. 5, 6A and 6B, the pitch of musical tone to be generated is varied between +200 cents and −200 cents alternatively. Such depression can be performed by the fingers of one hand of the player. Therefore, such depression can be performed with ease and with high speed, so that the present embodiment can further improve the manipulative capability as compared to the conventional unit using the wheel 1 as shown in FIG. 1.

(2) The player depresses the pitch-bend switches PU1 and PD1 alternatively. Thus, the pitch of a musical tone to be generated is varied between +28.5 cents and −28.5 cents. Such small variation of pitch cannot be obtained by the conventional unit using the wheel. However, the present embodiment can vary the pitch by such minute variation value with ease and with accuracy by alternatively depressing two pitch-bend switches.

(3) The player slides his finger on the pitch-bend switches so as to continuously turn on these pitch-bend switches. As a result, the pitch variation amount is sequentially designated in response to the movement of the finger of player, so that the player can arbitrarily perform the desirable pitch control.

[C] MODIFIED EXAMPLES OF PRESENT EMBODIMENT

The present embodiment can be modified as described below.

Figure 9:
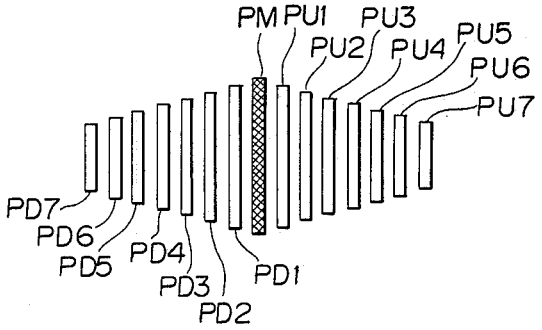
FIG. 9 is a plan view showing another example of the pitch-bend switches used in the present embodiment.

(1) Since the pitch-bend switch must be designed such that the pitch-bend switch can be depressed, its shape can be freely set. For example, as shown in FIG. 9, it is possible to vary the length of each pitch-bend switch so that the pitch variation amount can be expressed visually.

Figure 10:
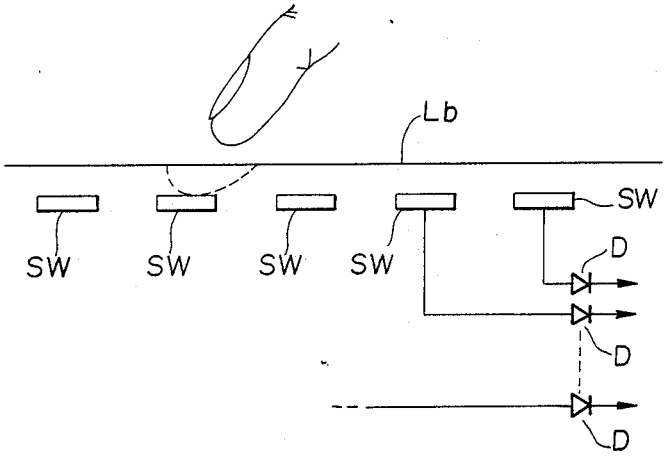
FIG. 10 is a view showing still another example of the pitch-bend switches used in the present embodiment.

(2) It is possible to re-design the shape of a (pitch-bend switch from the projection shape to the flat shape. For example, as shown in FIG. 10, plural switch elements SW (e.g., film switches or rubber contacts) are provided under an upper resin film Lb, and a switch signal from each switch element SW is supplied to the CPU 14 via each diode D. The CPU 14 sequentially scans the switch signal to thereby detect the depressed switch.

In this case, it is possible to freely write a mark indicative of each switch position on the surface of upper resin film Lb. Therefore, there is a large degree of freedom in the design of such mark. In this case, the player can slide his finger on such flat switches shown in FIG. 10 easier a compared to the pitch-bend switches as shown in FIGS. 3 and 9.

(3) The present embodiment performs the pitch control by use of the pitch-bend switches. However, the present invention is not limited to such pitch control. Instead of such pitch control, it is possible to control the tone color, tone volume, depth of modulation signal for modulating the musical tone signal, frequency and the like. In addition, it is possible to re-design the present embodiment to simultaneously control two or more musical tone elements by control data (i.e., musical tone control parameters) which are obtained by operating one pair of switches.

(4) The present embodiment executes its processes by use of the software. Instead, it is possible to use the hardware which is exclusively used for executing such processes.

(5) The interpolation process of depressed pitch-bend switch is not limited to the interpolation based on the exponential operation (see the steps Sc3 and Sc4 shown in FIG. 7). Instead, it is possible to employ other kinds of interpolation operations. In this case, it is possible to redesign the present embodiment such that several kinds of interpolation operations are provided in advance and then the player can arbitrarily select any one of these interpolation operations.

(6) In the present embodiment, the target value in the variation of control data is set in response to the newly turned-on switch (i.e., the switch whose on-event is the latest). Instead, it is possible to scan each switch by every constant time to thereby detect the switch which is turned on. In this case, when it is detected that only one switch is turned on, the target value of control data must be set in response to that switch. On the other hand, when it is detected that plural switches are turned on, one of the turned-on switches is selected in the pitch-up side or pitch-down side so that the target value of control data can be set in response to such selected switch.

(7) In the present embodiment, the variation range is set as ±200 cents. However, it is possible to re-design the present embodiment such that the player can freely change this variation range.

Above is the description of the present embodiment. This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A control unit for an electronic musical instrument, comprising:

(a) a plurality of switches each of which is assigned a corresponding predetermined value, wherein each switch is individually operable to designate a desired predetermined value as control data for controlling a musical tone;

(b) detecting means for detecting an operation state of each switch; and (c) control means for smoothly varying a value of control data from a present value to a target value corresponding to an operated switch when said detecting means detects that any one of said switches is operated, said control means smoothly reverting said value of control data from a present value to a predetermined reference value when said detecting means detects that no switch is operated.

2. A control unit for an electronic musical instrument according to claim 1 wherein said control data are data for controlling a pitch of said musical tone.

3. A control unit for an electronic musical instrument according to claim 2 wherein said plurality of switches includes first switches and second switches, said first switches being assigned predetermined positive pitch values to be incremented from a present pitch value of a tone when each of said first switches is operated, said second switches being assigned predetermined negative pitch values to be decremented from a present pitch value of a tone when each of said second switches is operated.

4. A control unit for an electronic musical instrument according to claim 3 wherein each of said first and second switches has a shape which can easily be operated by a player with high speed.

5. A control unit for an electronic musical instrument according to claim 3 wherein said first or second switches are operated so that the present pitch value of a tone approaches a corresponding target pitch value linearly.

6. A control unit for an electronic musical instrument according to claim 3 wherein said first or second switches are operated so that the present pitch value of a tone approaches a corresponding target pitch value in an exponential manner.

7. A control unit for an electronic musical instrument, comprising:

plural operators, each operator being assigned a corresponding predetermined value and each operator having discrete operational states individually selectable by a player, wherein a player designates a desired predetermined value by setting a corresponding operator in the discrete operational state corresponding to the desired predetermined value;

means for detecting an operational state of each operator; and control means for varying by increments a value of control data from a present value to a target value corresponding to a detected operational state of an operator when the detecting means detects that any of the plural operators has been operated, the value of each of the increments being a fraction of the difference between the target value and the present value of the control data, the control data being used to control a musical tone, and the control means reverting by increments the value of control data from a present value to a predetermined reference value when the detecting means detects that no operator is operated, the value of each increment being a fraction of the difference between the predetermined reference value and the present value of the control data.

8. A control unit for an electronic musical instrument, comprising:

a sequence of operators, each operator being assigned a corresponding predetermined value such that the sequence of operators represents a spectrum of values of control data for controlling a musical tone, wherein each operator has discrete operational states individually selectable by a player to designate a desired predetermined value as control data for controlling a musical tone;

means for detecting an operational state of each operator; and control means for smoothly varying a value of control data from a present value to a target value corresponding to a detected operational state of an operator when the detecting means detects that any of the plural operators has been operated, the control means smoothly reverting the value of control data from a present value to a predetermined reference value when the detecting means detects that no operator is operated.

9. A pitch bend device for an electronic musical instrument, the electronic musical instrument having plural operators each of which is operable to designate a musical tone having a corresponding reference pitch value and means for generating a musical tone in accordance with an operated operator, the pitch bend device comprising:

plural switches each of which is assigned a pitch change value, wherein each switch is individually operable to designate a desired pitch change value;

means for detecting an operation state of each switch; and control means for smoothly varying a value of control data from a reference pitch value of an operated operator to a target pitch value in accordance with the pitch change value of an operated switch, the control data being used to control the pitch of a musical tone, wherein the pitch of a musical tone currently being generated by the musical tone generating means is smoothly shifted in accordance with the pitch change value of the operated switch, the control means smoothly reverting the value of control data from a present value to the reference pitch value when the detecting means detects that no switch is operated, the pitch of the musical tone currently being generated by the musical tone generating means being smoothly shifted in accordance with the reference pitch value.

* * * * *